US011813633B1

(12) United States Patent
Xie

(10) Patent No.: US 11,813,633 B1
(45) Date of Patent: Nov. 14, 2023

(54) LEAK-PROOF FOAM SPRAYING CAN

(71) Applicant: Xiangcheng Xie, Hunan Province (CN)

(72) Inventor: Xiangcheng Xie, Hunan Province (CN)

( * ) Notice: Subject to any disclaimer, the term of this patent is extended or adjusted under 35 U.S.C. 154(b) by 0 days.

(21) Appl. No.: 18/150,473

(22) Filed: Jan. 5, 2023

(30) Foreign Application Priority Data

Jul. 29, 2022 (CN) ..... 202221988420.1

(51) Int. Cl.
*B05B 7/24* (2006.01)
*B05B 7/00* (2006.01)

(52) U.S. Cl.
CPC ..... *B05B 7/2408* (2013.01); *B05B 7/0018* (2013.01)

(58) Field of Classification Search
CPC ... B05B 7/2408; B05B 7/0018; B05B 7/2443; B05B 15/40
See application file for complete search history.

(56) References Cited

U.S. PATENT DOCUMENTS 4,014,448 A * 3/1977 Greenberg ..... B28B 1/002 215/44
4,165,816 A * 8/1979 Tupper ..... B65D 51/165 220/203.14
4,388,997 A * 6/1983 Grime ..... B05B 7/2408 220/203.14
4,867,354 A * 9/1989 Schreiber ..... B65D 47/242 222/521
5,033,654 A * 7/1991 Bennett ..... B05B 11/043 222/522
5,862,948 A * 1/1999 Duchon ..... B67D 7/02 222/472
6,604,693 B2 * 8/2003 Santagiuliana ..... B05B 11/043 222/190
10,226,779 B2 * 3/2019 Loiti Urquia ..... B05B 7/2467
10,639,656 B1 * 5/2020 Hammerlund .... B01F 33/50114
2005/0103893 A1 * 5/2005 Birrenkott ..... B05B 7/0408 239/581.1
2007/0102542 A1 * 5/2007 MacLean-Blevins .... B05B 7/12 239/318

* cited by examiner

*Primary Examiner* — Vishal Pancholi

(57) ABSTRACT

The present disclosure discloses a leak-proof foam spraying can, characterized in that it includes a liquid tank, a liquid tank lid and a duckbill valve, wherein the top of the liquid tank is provided with a liquid injection port, the liquid tank lid is engaged on the liquid injection port, the liquid tank lid is provided with a mounting hole which penetrates through the liquid tank lid along the vertical direction from the top to the bottom, and the duckbill valve is mounted in the mounting hole and the opening of the duckbill valve faces downward. The present disclosure has the following advantageous effects: by mounting a duckbill valve in the liquid tank lid, the duckbill valve can be opened when the spraying can is in use and suck air to equalize the pressure, or it can be closed when the spraying can is inverted to avoid leaking cleaning agent or disinfectant.

6 Claims, 5 Drawing Sheets

LEAK-PROOF FOAM SPRAYING CAN

TECHNICAL FIELD OF THE INVENTION

The present disclosure relates to the technical field of spraying can, specifically relates to a leak-proof foam spraying can.

BACKGROUND OF THE INVENTION

Foam spraying can is a common spraying device with strong practicability, and is widely used for cleaning work in different places such as homes, companies and schools and the like due to the characteristics of small size, small occupied area, easy to carry, handheld operation and the like. When cleaning and washing objects, the spray head of the foam spraying can mix the cleaning agent or disinfectant with water and air and sprays it from the nozzle, thereby spraying a certain amount of foam.

However, the existing spraying cans require the cleaning agent in the liquid tank to be sucked into the spray head during use. As the cleaning agent inside the liquid tank gradually decreases, the pressure in the liquid tank will decrease, and the pressure difference between the inside and outside will easily lead to the problem of deformation and damage to the liquid tank. Therefore, in the prior art, the liquid tank is generally provided with an air inlet to equalize the pressure inside the liquid tank. However, when the spraying can is inverted, the air inlet is easy for the cleaning agent or disinfectant to leak outward, and the cleaning agent or disinfectant will contaminate the liquid tank lid, so that the liquid tank lid is not suitable for a use by hand touch.

SUMMARY OF THE INVENTION

The present disclosure aims at providing a leak-proof foam spraying can. By mounting a duckbill valve in the liquid tank lid, the duckbill valve can be opened when the spraying can is in use and suck air to equalize the pressure, or it can be closed when the spraying can is inverted to avoid leaking cleaning agent or disinfectant.

In order to realize the purpose of the present disclosure, the present disclosure provides the following technical solutions:

A leak-proof foam spraying can, characterized in that it includes a liquid tank, a liquid tank lid and a duckbill valve, wherein the top of the liquid tank is provided with a liquid injection port, the liquid tank lid is engaged on the liquid injection port, the liquid tank lid is provided with a mounting hole which penetrates through the liquid tank lid along the vertical direction from the top to the bottom, and the duckbill valve is mounted in the mounting hole and the opening of the duckbill valve faces downward, that is, the duckbill valve is mounted in the mounting hole along the direction of its opening facing downward.

Preferably, the duckbill valve comprises a first duckbill valve and a second duckbill valve, the mounting hole includes a first mounting hole arranged on one side of the liquid tank lid and a second mounting hole arranged on the other side of the liquid tank lid. The first duckbill valve is mounted in the first mounting hole and the second duckbill valve is mounted in the second mounting hole. Separate arrangement of the first duckbill valve and the second duckbill valve can improve the air inlet efficiency of the liquid tank lid to ensure that the pressure inside the liquid tank is balanced with the outside, that is, the external environment.

Preferably, the outer side wall of the liquid tank is provided with a spiral snap, the outer side wall of the liquid injection port is provided with an external thread, the liquid tank lid is provided with a spiral snap groove and an internal thread, the spiral snap and the spiral snap groove are snapped together, the external thread and the internal thread are rotatably snapped together to ensure that the liquid injection port of the liquid tank and the liquid tank lid can be firmly mounted and are not easy to fall off.

Preferably, the spiral snap is so configured, that the spiral snap and the spiral snap groove are screwed for sixty degrees to ninety degrees and then engaged, which can quickly assembly the liquid tank lid and the liquid tank without screwing the liquid tank lid too much, thereby saving manual operation.

Preferably, the inner side of the liquid tank lid is provided with a cylindrical element, and the outer wall of the cylindrical element is provided with a cylindrical element sealing ring. The cylindrical element can ensure that the liquid tank lid and the liquid tank can be fitted together more tightly, while the cylindrical element sealing ring can enhance the tightness between the cylindrical element and the liquid injection port.

Preferably, the cylindrical element sealing ring comprises a first cylindrical element sealing ring and a second cylindrical element sealing ring, the first cylindrical element sealing ring and the second cylindrical element sealing ring are sleeved on the cylindrical element respectively. The first cylindrical element sealing ring and the second cylindrical element sealing ring can provide a better sealing effect to avoid the liquid inside the liquid tank from leaking out of the liquid tank lid.

Preferably, a liquid tank sealing ring is arranged at the connection between the liquid tank and the liquid tank lid. The liquid tank sealing ring can enhance the tightness between the liquid tank lid and the liquid injection port.

Preferably, the liquid tank sealing ring comprises a first liquid tank sealing ring and a second liquid tank sealing ring, the first liquid tank sealing ring and the second liquid tank sealing ring are sleeved on the liquid tank respectively. The first liquid tank sealing ring and the second liquid tank sealing ring can provide a better sealing effect to avoid the liquid inside the liquid tank from leaking out of the liquid tank lid.

Compared with the prior art, the present disclosure has the following advantageous effects:

In the present disclosure, by providing the liquid tank lid with a mounting hole which penetrates through the liquid tank lid along the vertical direction and mounting the duckbill valve in the mounting hole along the direction of its opening facing downward, since the duckbill valve has the characteristic that the outward flow along the direction of the opening of the duckbill valve is not obstructed, while the reverse flow is obstructed, air can flow towards the inside of the liquid tank along the opening of the duckbill valve so as to equalize the pressure in the liquid tank and ensure that the liquid in the liquid tank can be normally sucked into the spray head, and the liquid in the liquid tank cannot leak out from the liquid tank through the opening of the duckbill valve, so the duckbill valve plays the function of preventing the backflow of liquid. Therefore, when the liquid tank lid is inverted, the cleaning agent or detergent inside the liquid tank will not flow out from the liquid tank, and the liquid will not leak out whether the liquid tank is tilted or inverted, so that users can use it with confidence.

Therefore, the present disclosure provides a leak-proof foam spraying can. By mounting a duckbill valve in the liquid tank lid, the duckbill valve can be opened when the spraying can is in use and suck air to equalize the pressure, or it can be closed when the spraying can is inverted to avoid leaking cleaning agent or disinfectant.

DETAILED DESCRIPTION OF THE PREFERRED EMBODIMENT

Figure 1:
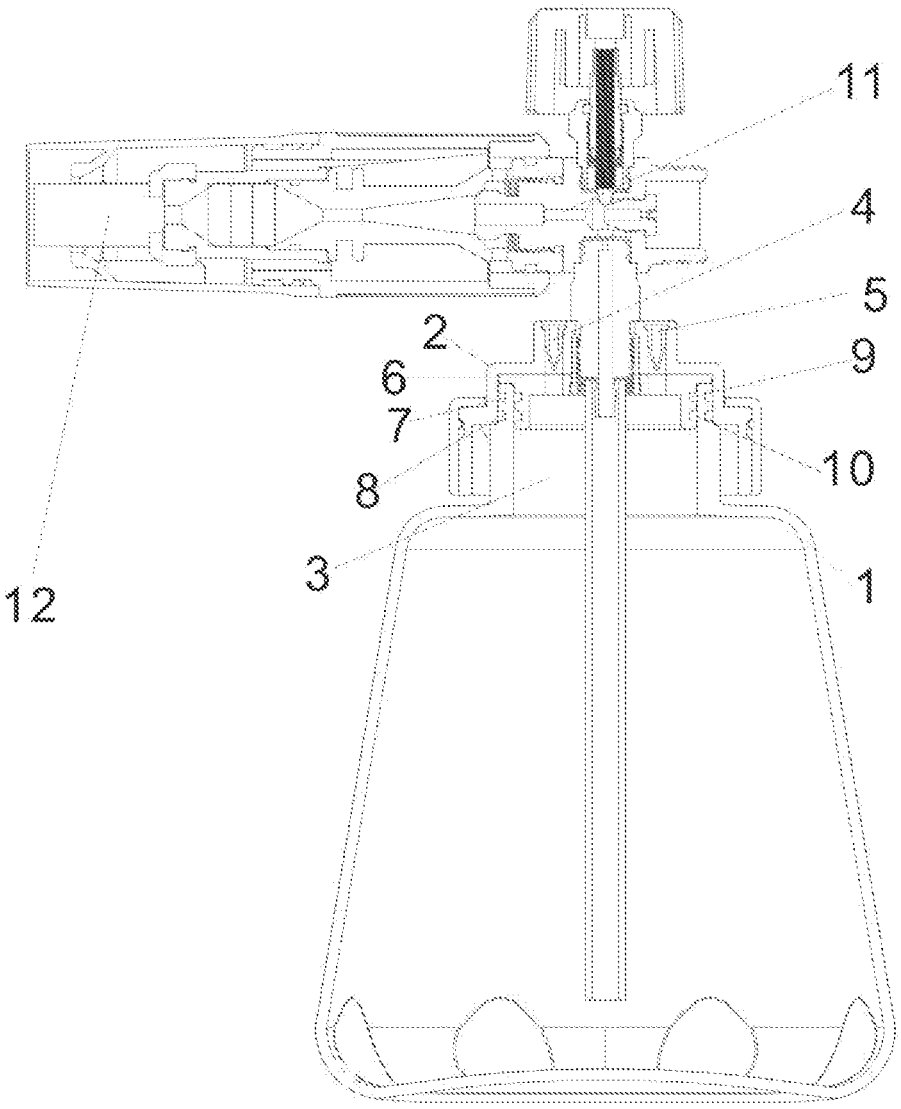
FIG. 1 is a cross-sectional view of the present disclosure.
Figure 2:
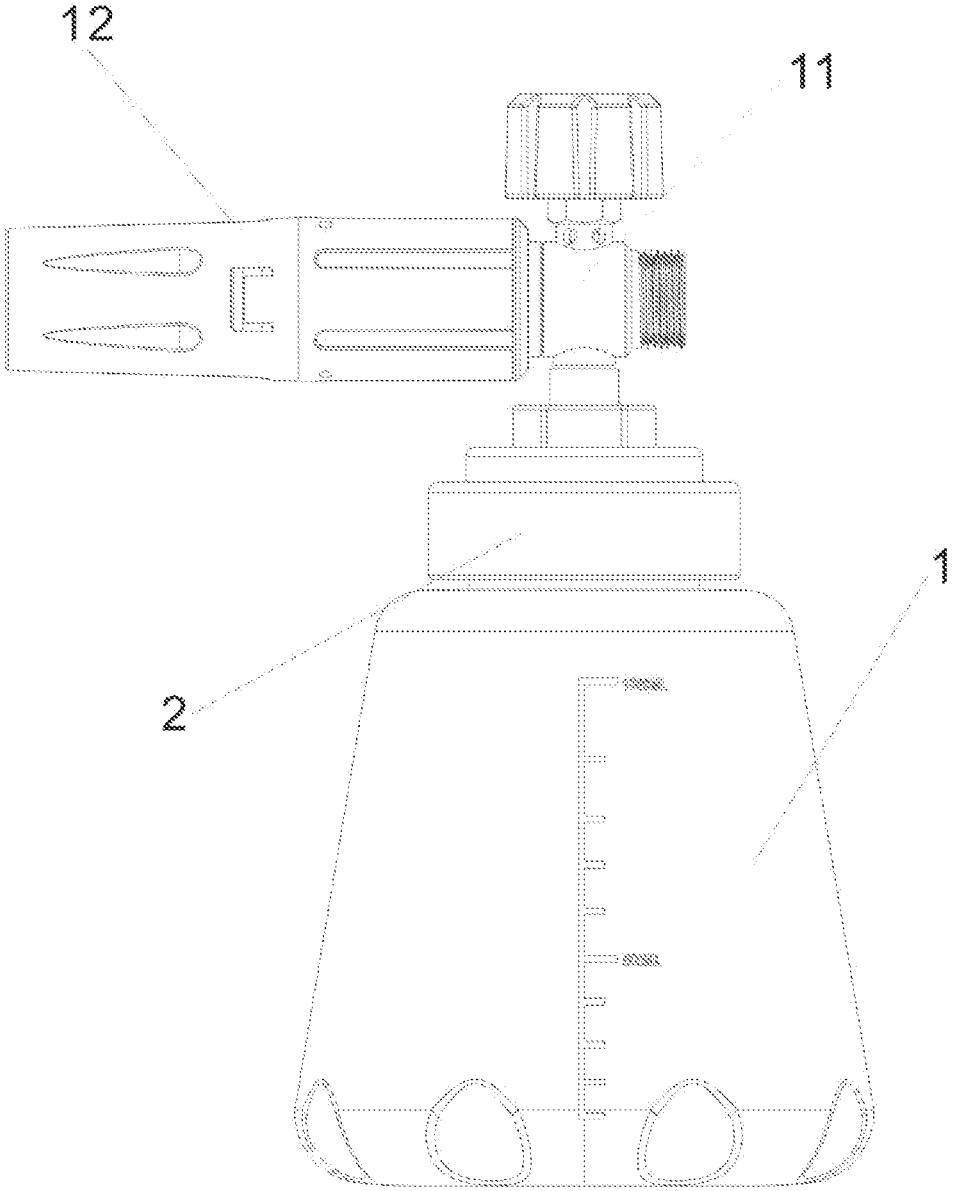
FIG. 2 is a schematic front view of the structure of the present disclosure.

The technical solutions of the embodiments of the present disclosure will be clearly and entirely described below with the drawings of the embodiments of the present disclosure. Obviously, the described embodiments are just a part of the embodiments of the present disclosure, and are not all of them. All other embodiments that can be obtained by a person skilled in the art based on the embodiments of the present disclosure without any creative effort are included in the protection scope of the present disclosure.

It should be noted that, all the directional indications (such as up, down, left, right, front, rear . . . ) in the embodiments of the present disclosure are merely used for explaining the relative positional relationship and movement conditions and the like between each part under a certain posture (as shown in the drawings), if such a posture changes, then the directional indications are changed correspondingly.

In the present disclosure, such description involving "first" and "second" and the like are merely for the purpose of description, but cannot be understood as indicating or implying its relative importance or implicitly indicating the quantity of the indicated technical features. Therefore, the feature defined with "first" and "second" can explicitly or implicitly include at least one such feature; secondly, in the description of the present disclosure, "a plurality of" means at least two, for example, two, three and the like, unless otherwise specifically defined.

In the present disclosure, unless otherwise definitely prescribed and defined, the terms "connection", "connected", "fixed" and the like should be understood in its broad sense. For example, the "connection" may be a fixed connection, may also be a detachable connection or an integrated connection; may be a mechanical connection, may also be an electrical connection; and the "connected" may be directly connected and can also be indirectly connected through an intermediate medium, and can also be the internal communication inside two elements or an interaction relationship between two elements, unless otherwise definitely defined. The specific meaning of the above-mentioned terms in the present disclosure may be understood by those of ordinary skill in the art in light of specific circumstances.

In addition, the technical solutions between each embodiment in the present disclosure can be mutually combined, but should be on the basis that the technical solutions can be realized by those skilled in the art, when the combination of the technical solutions is contradictory or cannot be realized, it should be deemed that the combination of technical solutions does not exist and does not fall within the protection scope claimed by the present disclosure.

The embodiments of the present disclosure provide a leak-proof foam spraying can. The names of the components corresponding to the reference numerals in the figures are as follows: 1. liquid tank; 2. liquid tank lid; 3. liquid injection port; 4. first duckbill valve; 5. second duckbill valve; 6. cylindrical element; 7. First liquid tank sealing ring; 8. Second liquid tank sealing ring; 9. first cylindrical element sealing ring; 10. second cylindrical element sealing ring; 11. spray head; 12. nozzle; 13. spiral snap groove; 14. internal thread; 15. external thread; 16. spiral snap.

A leak-proof foam spraying can includes a liquid tank 1, a liquid tank lid 2 and a duckbill valve, wherein the top of the liquid tank 1 is provided with a liquid injection port 3, the liquid tank lid 3 is engaged on the liquid injection port 2, the liquid tank lid 2 is provided with a mounting hole which penetrates through the liquid tank lid 2 along the vertical direction from the top to the bottom, and the duckbill valve is mounted in the mounting hole and the opening of the duckbill valve faces downward.

The use and working method of the present disclosure is as follows:

the duckbill valve is mounted in the mounting hole and the opening of the duckbill valve faces downward, the liquid tank lid 2 is engaged on the liquid injection port 3 to accomplish the assembly of the liquid tank lid 2, and when in use, the liquid in the liquid tank 1 is sucked into the spray head 11 and is sprayed out through the nozzle 12, air enters the liquid tank 1 downwards along the duckbill valve to equalize the pressure of the liquid tank 1 and the outside environment, when the liquid tank 1 is inclined or inverted, the opening of the duckbill valve is closed, and the liquid cannot leak out of the duckbill valve.

As shown in FIG. 1, the duckbill valve comprises a first duckbill valve 4 and a second duckbill valve 5. The mounting hole includes a first mounting hole arranged on one side of the liquid tank lid 2 and a second mounting hole arranged on the other side of the liquid tank lid 2. The first duckbill valve 4 is mounted in the first mounting hole and the second duckbill valve 5 is mounted in the second mounting hole. Separate arrangement of the first duckbill valve 4 and the second duckbill valve 5 can improve the air inlet efficiency of the liquid tank lid 2 to ensure that the pressure inside the liquid tank 1 is balanced with the outside environment.

Figure 3:
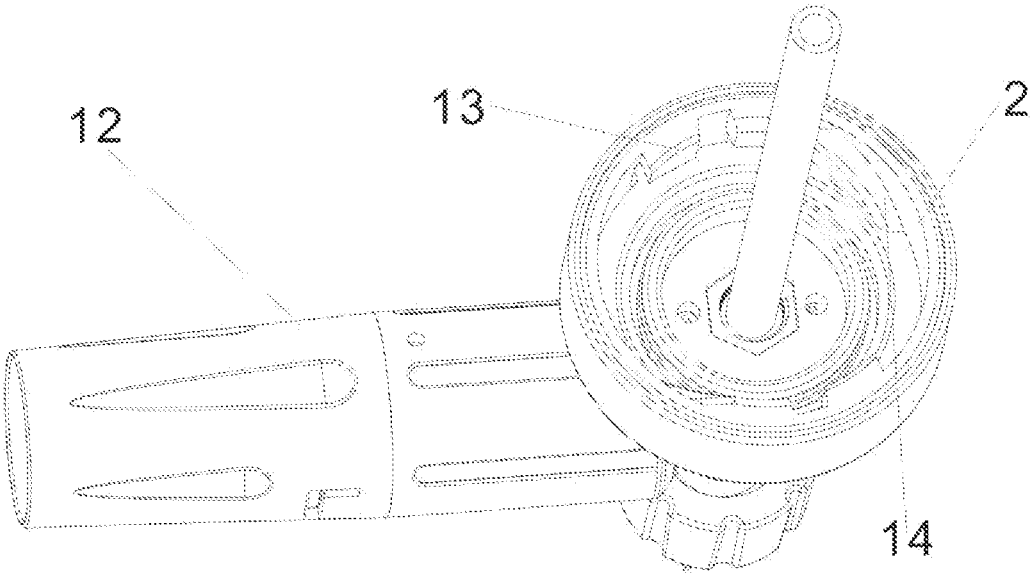
FIG. 3 is a schematic view of the structure of the liquid tank lid of the present disclosure.
Figure 4:
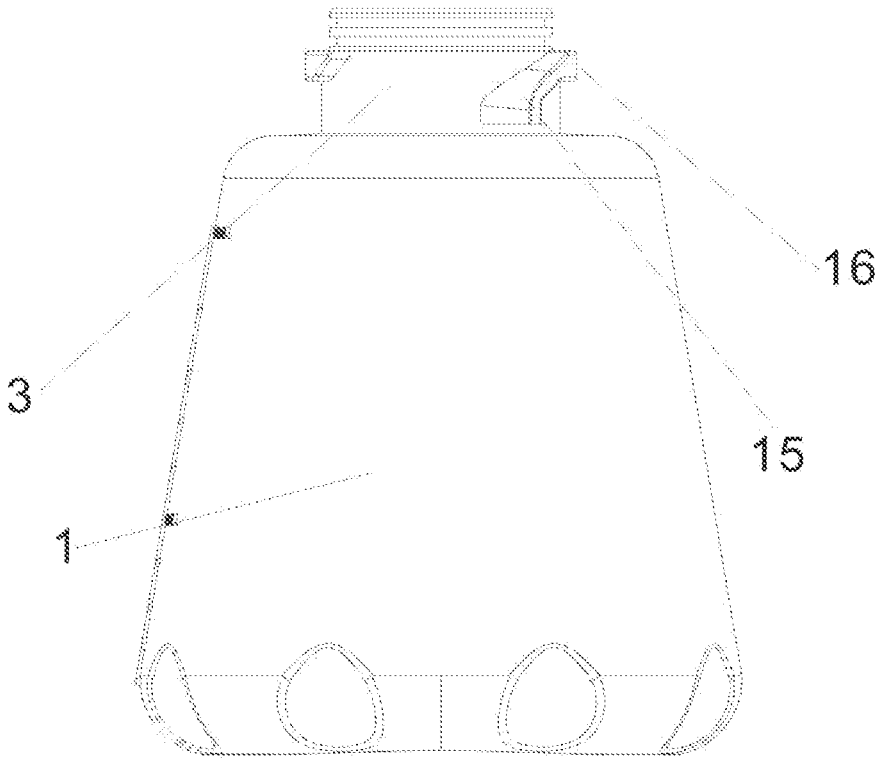
FIG. 4 is a schematic view of the structure of the liquid tank of the present disclosure.
Figure 5:
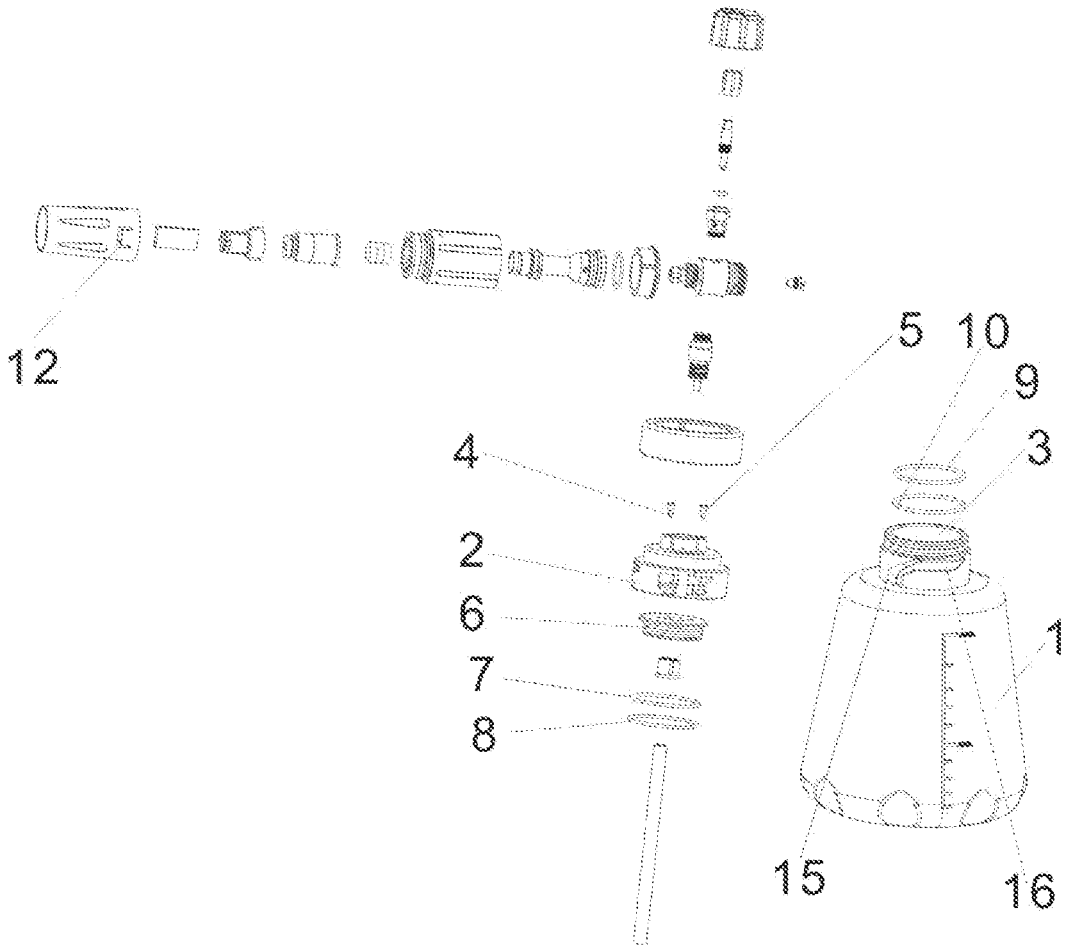
FIG. 5 is a schematic view of the split structure of the present disclosure.

As shown in FIGS. 3 and 4, the outer side wall of the liquid tank 1 is provided with a spiral snap 16, the outer side wall of the liquid injection port 3 is provided with an external thread 15, the liquid tank lid 2 is provided with a spiral snap groove 13 and an internal thread 14, the spiral snap 16 and the spiral snap groove 13 are snapped together, the external thread 15 and the internal thread 14 are rotatably snapped together to ensure that the liquid injection port 3 of the liquid tank 1 and the liquid tank lid 2 can be firmly mounted and are not easy to fall off.

The spiral snap 16 is so configured, that the spiral snap and the spiral snap groove 13are screwed for sixty degrees to ninety degrees and then engaged, which can quickly assembly the liquid tank lid 2 and the liquid tank 1 without screwing the liquid tank lid 2 too much, thereby saving manual operation.

The inner side of the liquid tank lid 2 is provided with a cylindrical element 6, and the outer wall of the cylindrical element 6 is provided with a cylindrical element sealing ring. The cylindrical element 6 can ensure that the liquid tank lid 2 and the liquid tank 1 can be fitted together more tightly, while the cylindrical element sealing ring can enhance the tightness between the cylindrical element 6 and the liquid injection port 3.

The cylindrical element sealing ring comprises a first cylindrical element sealing ring 9 and a second cylindrical element sealing ring 10, the first cylindrical element sealing ring 9 and the second cylindrical element sealing ring 10are sleeved on the cylindrical element 6 respectively. The first cylindrical element sealing ring 9 and the second cylindrical element sealing ring 10 can provide a better sealing effect to avoid the liquid inside the liquid tank 1 from leaking out of the liquid tank lid 2.

A liquid tank sealing ring is arranged at the connection between the liquid tank 1 and the liquid tank lid 2. The liquid tank sealing ring can enhance the tightness between the liquid tank lid 2 and the liquid injection port 3.

The liquid tank sealing ring comprises a first liquid tank sealing ring 7 and a second liquid tank sealing ring 8, the first liquid tank sealing ring 7 and the second liquid tank sealing ring 8 are sleeved on the liquid tank respectively. The first liquid tank sealing ring 7 and the second liquid tank sealing ring 8 can provide a better sealing effect to avoid the liquid inside the liquid tank 1 from leaking out of the liquid tank lid 2.

Compared with the prior art, the present disclosure has the following advantageous effects:

in the present disclosure, by providing the liquid tank lid 2 with a mounting hole which penetrates through the liquid tank lid 2 along the vertical direction and mounting the duckbill valve in the mounting hole along the direction of its opening facing downward, since the duckbill valve has the characteristic that the outward flow along the direction of the opening of the duckbill valve is not obstructed, while the reverse flow is obstructed, air can flow towards the inside of the liquid tank 1 along the opening of the duckbill valve so as to equalize the pressure in the liquid tank 1 and ensure that the liquid in the liquid tank 1 can be normally sucked into the spray head 11, and the liquid in the liquid tank 1 cannot leak out from the liquid tank 1 through the opening of the duckbill valve, so the duckbill valve plays the function of preventing the backflow of liquid. Therefore, when the liquid tank lid 2 is inverted, the cleaning agent or detergent inside the liquid tank 1 will not flow out from the liquid tank 1, and the liquid will not leak out whether the liquid tank 1 is tilted or inverted, so that users can use it with confidence.

Therefore, the present disclosure provides a leak-proof foam spraying can. By mounting a duckbill valve in the liquid tank lid 2, the duckbill valve can be opened when the spraying can is in use and suck air to equalize the pressure, or it can be closed when the spraying can is inverted to avoid leaking cleaning agent or disinfectant.

The above described embodiments are only the preferred embodiments of the present disclosure. It should be noted that, the present disclosure is not limited to the above preferred embodiments, and the protection scope of the present disclosure is defined by the claims. For a person skilled in the art, on the premise of not departing away from the spirit and scope of the present disclosure, several improvements and modifications may also be made, and such improvements and modifications are also deemed to be within the protection scope of the present disclosure.

The invention claimed is:

1. A leak-proof foam spraying can, characterized in that it includes a liquid tank, a liquid tank lid and a duckbill valve, wherein the top of the liquid tank is provided with a liquid injection port, the liquid tank lid is engaged on the liquid injection port, the liquid tank lid is provided with a mounting hole which penetrates through the liquid tank lid along the vertical direction from the top to the bottom, and the duckbill valve is mounted in the mounting hole and the opening of the duckbill valve faces downward, wherein an inner side of the liquid tank lid is provided with a cylindrical element, and an outer wall of the cylindrical element is provided with a cylindrical element sealing ring, the cylindrical element sealing ring comprises a first cylindrical element sealing ring and a second cylindrical element sealing ring, the first cylindrical element sealing ring and the second cylindrical element sealing ring are sleeved on the cylindrical element respectively.

2. The leak-proof foam spraying can according to claim 1, characterized in that the duckbill valve comprises a first duckbill valve and a second duckbill valve, the mounting hole includes a first mounting hole arranged on one side of the liquid tank lid and a second mounting hole arranged on the other side of the liquid tank lid, the first duckbill valve is mounted in the first mounting hole and the second duckbill valve is mounted in the second mounting hole.

3. The leak-proof foam spraying can according to claim 1, characterized in that an outer side wall of the liquid tank is provided with a spiral snap, an outer side wall of the liquid injection port is provided with an external thread, the liquid tank lid is provided with a spiral snap groove and an internal thread, the spiral snap and the spiral snap groove are snapped together, the external thread and the internal thread are rotatably snapped together.

4. The leak-proof foam spraying can according to claim 3, characterized in that the spiral snap and the spiral snap groove are screwed for sixty degrees to ninety degrees and are then engaged.

5. The leak-proof foam spraying can according to claim 1, characterized in that a liquid tank sealing ring is arranged at the connection between the liquid tank and the liquid tank lid.

6. The leak-proof foam spraying can according to claim 5, characterized in that the liquid tank sealing ring comprises a first liquid tank sealing ring and a second liquid tank sealing ring, the first liquid tank sealing ring and the second liquid tank sealing ring are sleeved on the liquid tank respectively.

* * * * *